United States Patent [19]

Takashima et al.

[11] Patent Number: 4,707,464

[45] Date of Patent: Nov. 17, 1987

[54] RECORDING MATERIAL

[75] Inventors: Masanobu Takashima; Masato Satomura; Ken Iwakura; Akira Igarashi, all of Shizuoka, Japan

[73] Assignee: Fuji Photo Film Co., Ltd., Kanagawa, Japan

[21] Appl. No.: 933,514

[22] Filed: Nov. 21, 1986

[30] Foreign Application Priority Data

Nov. 22, 1985 [JP] Japan ..... 60-263228
Nov. 22, 1985 [JP] Japan ..... 60-263229
Dec. 20, 1985 [JP] Japan ..... 60-287068

[51] Int. Cl.[4] ..... B41M 5/16; B41M 5/18; B41M 5/22

[52] U.S. Cl. ..... 503/216; 427/150; 427/151; 427/152; 503/225

[58] Field of Search ..... 346/216, 217, 225; 427/150–152

[56] References Cited

FOREIGN PATENT DOCUMENTS 0056281 7/1982 European Pat. Off. ..... 346/225
0228189 11/1985 Japan ..... 346/216

*Primary Examiner*—Bruce H. Hess

*Attorney, Agent, or Firm*—Sughrue, Mion, Zinn, Macpeak & Seas

[57] ABSTRACT

A recording material comprising: one or more supports, an electron donating leuco dye and one or more electron accepting compound(s) is disclosed, in which said electron accepting compound(s) is/are represented by formula (I):

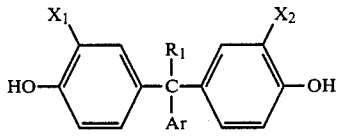

(I)

wherein $R_1$ represents a hydrogen atom, an alkyl group or an aryl group; Ar represents a substituted or unsubstituted polycyclic aryl group; and $X_1$ and $X_2$, which may be the same or different, each represents a hydrogen atom, a lower alkyl group, a lower alkenyl group or a halogen atom. The material exhibits improved preservability before and after recording and solvent resistance.

4 Claims, No Drawings

RECORDING MATERIAL

FIELD OF THE INVENTION

This invention relates to a recording material utilizing a color formation reaction between an electron donating leuco dye and an electron accepting compound. More particularly, it relates to a recording material using a novel electron accepting compound and exhibiting improved preservability and solvent resistance.

BACKGROUND OF THE INVENTION

It is known to use various kinds of phenol compounds as electron accepting compounds for pressure-sensitive recording materials or heat-sensitive recording materials, as disclosed in Japanese Patent Publication Nos. 9309/65, 14039/70 (corresponding to British Pat. 1,135,540) and 29830/76, etc. These known phenol compounds, however, are not always satisfactory as electron accepting compounds. In some detail, they are associated with problems such that a color image developed upon reaction with an electron donating leuco dye does not have sufficient density; the density of a color image developed is reduced with time; a white powder is precipitated on the surface (so-called blooming); and the like.

SUMMARY OF THE INVENTION

Accordingly, one object of this invention is to provide a recording material which develops a color of sufficient density upon reaction between an electron donating leuco dye and an electron accepting compound.

Another object of this invention is to provide a recording material which has improved preservability before and after recording and improved solvent resistance.

The above objects can be accomplished by providing a recording material comprising: one or more supports, an electron donating leuco dye and one or more electron accepting compound(s), wherein said electron accepting compound(s) is/are represented by formula (I):

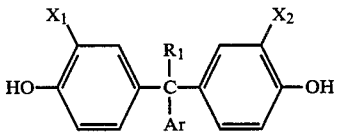

(I)

wherein $R_1$ represents a hydrogen atom, an alkyl group or an aryl group; Ar represents a substituted or unsubstituted polycyclic aryl group; and $X_1$ and $X_2$, which may be the same or different, each represents a hydrogen atom, a lower alkyl group, a lower alkenyl group or a halogen atom.

DETAILED DESCRIPTION OF THE INVENTION

The compounds represented by formula (I) specifically include compounds represented by formulae (II) or (III).

Formula (II) is represented by

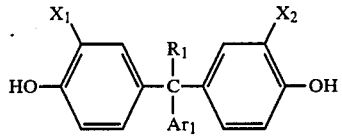

(II)

wherein $R_1$, $X_1$ and $X_2$ are as defined above; and $Ar_1$ represents a condensed ring composed of substituted or unsubstituted 5- or 6-membered homocyclic or heterocyclic rings.

Formula (III) is represented by

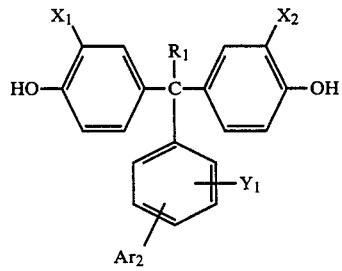

(III)

wherein $R_1$, $X_1$ and $X_2$ are as defined above; $Ar_2$ represents a substituted or unsubstituted 5- or 6-membered homocyclic or heterocyclic ring or a condensed ring composed of substituted or unsubstituted 5- or 6-membered homocyclic or heterocyclic rings; and $Y_1$ represents a hydrogen atom, a halogen atom, an alkyl group or an alkoxy group.

In the compounds represented by formula (III), compounds represented by the following formulae (IV) and (V) are preferred.

Formula (IV) is represented by

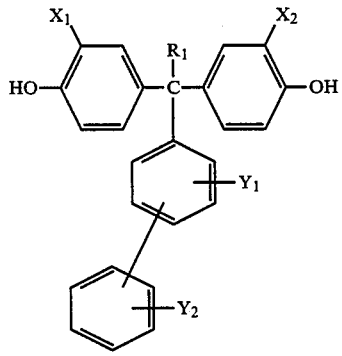

(IV)

wherein $R_1$, $X_1$, $X_2$ and $Y_1$ are as defined above; and $Y_2$ has the same meaning as $Y_1$. $X_1$ and $X_2$ may be the same or different and $Y_1$ and $Y_2$ may be the same or different.

Formula (V) is represented by

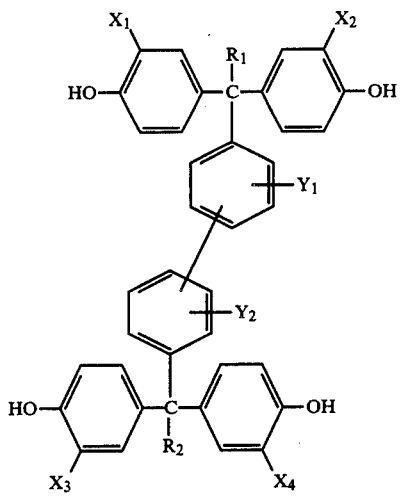

(V)

wherein $R_1$, $X_1$, $X_2$ and $Y_1$ are as defined above; $R_2$ has the same meaning as $R_1$; $X_3$ and $X_4$ have the same meaning as $X_1$ and $X_2$; and $Y_2$ has the same meaning as $Y_1$. $R_1$ and $R_2$ may be the same or different, $X_1$, $X_2$, $X_3$ and $X_4$ may be the same or different, and $Y_1$ and $Y_2$ may be the same or different.

In the above-described formulae (I) to (V), $R_1$ preferably represents a hydrogen atom or a lower alkyl group, e.g., a methyl group, an ethyl group, an n-propyl group or an n-butyl group.

The substituents represented by $X_1$, $X_2$, $X_3$ or $X_4$ preferably include a hydrogen atom, a methyl group, an allyl group, and a chlorine atom.

The condensed ring represented by $Ar_1$ or $Ar_2$ specifically includes naphthalene, phenanthrene, pyrene, fluorene, etc. The hetero atom which may be contained in $Ar_1$ or $Ar_2$ includes an oxygen atom, a nitrogen atom and a sulfur atom. The substituents for the homocyclic or heterocyclic ring as represented by $Ar_1$ or $Ar_2$ include a halogen atom, an alkyl group, an alkoxy group, an acyl group, a carbamoyl group, a sulfamoyl group, a substituted amino group, a hydroxyl group, a cyano group, a sulfo group, a sulfonato group, etc. Of these, those having not more than 15 carbon atoms, and particularly not more than 4 carbon atoms, are preferred in view of performance properties as electron accepting compounds.

In formula (III), $Ar_2$ preferably represents a benzene ring or a naphthalene ring in view of availability of starting materials and ease in handling.

In cases where the electron accepting compounds represented by formula (I) are used for heat-sensitive recording materials, those having a melting point of not less than 50° C. are preferred, and those of from 70° to 200° C. are more preferred.

Characteristics of the compounds of the present invention are as follows:

(i) They provide a color image having high density upon reacting with an electron donating leuco dye.

(ii) The background and the color image of recording materials using these compounds exhibit satisfactory preservability and solvent resistance.

(iii) They do not undergo sublimation and are, therefore, stable.

Specific examples of the compounds represented by formulae (II), (III), (IV) and (V) are shown below, but they are not to limit the present invention.

1-[1,1-Bis(4-hydroxyphenyl)ethyl]naphthalene
2-[1,1-Bis(4-hydroxyphenyl)ethyl]naphthalene
1-[1,1-Bis(4-hydroxyphenyl)-n-propyl]naphthalene
2-[1,1-Bis(4-hydroxyphenyl)-n-butyl]naphthalene
1-[Bis(4-hydroxyphenyl)methyl]naphthalene
2-[Bis(4-hydroxyphenyl)methyl]naphthalene
2-[1,1-Bis(4-hydroxyphenyl)ethyl]phenanthrene
3-[1,1-Bis(4-hydroxyphenyl)ethyl]phenanthrene
1-[Bis(4-hydroxyphenyl)methyl]pyrene
1-[1,1-Bis(4-hydroxyphenyl)ethyl]pyrene
2-[1,1-Bis(4-hydroxyphenyl)ethyl]fluorene
4-[1,1-Bis(4-hydroxyphenyl)ethyl]biphenyl
4-[1,1-Bis(4-hydroxyphenyl)methyl]biphenyl
4-[1,1-Bis(4-hydroxyphenyl)-n-propyl]biphenyl
4-[1,1-Bis(4-hydroxyphenyl)-n-butyl]biphenyl
4-[1,1-Bis(4-hydroxyphenyl)ethyl]-4'-methylbiphenyl
4-[1,1-Bis(4-hydroxyphenyl)ethyl]-4'-ethylbiphenyl
4-[1,1-Bis(4-hydroxyphenyl)ethyl]-4'-methoxybiphenyl
4,4'-Bis[1,1-bis(4-hydroxyphenyl)ethyl]biphenyl
4,4'-Bis[1,1-bis(4-hydroxyphenyl)methyl]biphenyl
4,4'-bis[1,1-bis(4-hydroxyphenyl)-n-propyl]biphenyl
4,4'-Bis[1,1-bis(4-hydroxyphenyl)-n-butyl]biphenyl
4,4'-Bis[1,1-bis(3-methyl-4-hydroxyphenyl)ethyl]-biphenyl
4-[1,1-Bis(4-hydroxyphenyl)ethyl]-4'-[1,1-bis(4-hydroxyphenyl)methyl]biphenyl
4-[1,1-Bis(4-hydroxyphenyl)ethyl]-4'-[1,1-bis(4-hydroxyphenyl)-n-propyl]biphenyl The electron accepting compound represented by formula (I) in the present invention can be usually easily synthesized by stirring the mixture of an aromatic carbonyl compound and a phenol compound in the presence of a strong acid at a temperature of from about 40° to 100° C. for several hours. In the synthesis process, the reaction can be effectively processed by using a catalyst such as a mercapto compound.

Synthesis of the compounds according to the present invention will be illustrated below by way of Synthesis Examples.

SYNTHESIS EXAMPLE 1

Synthesis of 2-[1,1-Bis(4-hydroxyphenyl)ethyl]naphthalene

A 200 ml-volume flask was charged with 17.0 g of 2-acetylnaphthalene, 37.6 g of phenol and 0.3 ml of n-octylmercaptan. Hydrogen chloride gas was bubbled therethrough, and the mixture was stirred at 45° C. to 60° C. for 7 hours. The reaction mixture was thoroughly washed successively with water and benzene at 50° C. to obtain crystals of 2-[1,1-bis(4-hydroxyphenyl)ethyl]-naphthalene having a melting point of 185° to 186° C.

SYNTHESIS EXAMPLE 2

Synthesis of 1-[Bis(4-hydroxyphenyl)methyl]naphthalene

A 200 ml-volume flask was charged with 20 g of 1-naphthylaldehyde, 37.6 g of phenol and 0.4 ml of 3-mercaptopropionic acid. To the mixture was added 20 ml of concentrated hydrochloric acid, followed by stirring at 45° C. to 60° C. for 5 hours. The reaction mixture was thoroughly washed successively with water and benzene at 50° C. to obtain crystals of 1-[bis(4-hydroxyphenyl)methyl]naphthalene having a melting point of 109° to 111° C.

SYNTHESIS EXAMPLE 3

Synthesis of 4-[1,1-Bis(4-hydroxyphenyl)ethyl]biphenyl

A 200 ml-volume flask was charged with 19.6 g of 4-acetylbiphenyl, 37.6 g of phenol and 0.3 ml of n-octylmercaptan. To the mixture was added 30 ml of concentrated hydrochloric acid, or 30 ml of hydrogen chloride gas was bubbled through the mixture, and the mixture was stirred at 45° C. to 60° C. for 5 hours. The reaction mixture was subjected to column chromatography using silica gel as a carrier and ethyl acetate-n-hexane (1:2 by volume) as a developing solution to thereby obtain 4-[1,1-bis(4-hydroxyphenyl)ethyl]biphenyl having a melting point of 182° to 183° C.

Similarly, the compounds represented by formula (V) can be synthesized easily by reacting corresponding diacylbiphenyl compounds with phenol compounds under an acidic condition.

The electron accepting compounds represented by formula (I) can be used either alone or in combination. Further, they may be used in combination with other known electron accepting compounds. Examples of known electron accepting compounds to be used in combination include bisphenol A, benzyl 4-hydroxybenzoate, 1,1-bis(4-hydroxyphenyl)cyclohexane, zinc 3,5-bis(α-methylbenzyl)salicylate, active clay, etc.

The electron donating leuco dyes which can be used in the present invention include triarylmethane compounds, diphenylmethane compounds, xanthene compounds, thiazine compounds, spiropyran compounds, and the like.

Illustrative examples of the triarylmethane compounds include 3,3-bis(p-dimethylaminophenyl)-6-dimethylaminophthalide (i.e., Crystal Violet Lactone), 3,3-bis(p-dimethylaminophenyl)phthalide, 3-(p-dimethylaminophenyl)-3-(1,3-dimethylindol-3-yl)phthalide, 3-(p-dimethylaminophenyl)-3-(2-methylindol-3-yl)phthalide, etc. Examples of the diphenylmethane compounds include 4,4'-bisdimethylaminobenzhydrin benzyl ether, N-halophenylleucoauramines, N-2,4,5-trichlorophenylleucoauramine, etc. Examples of the xanthene compounds include Rhodamine B-anilinolactam, Rhodamine (p-nitroanilino)lactam, Rhodamine B (p-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-N-cyclohexyl-N-methylaminofluoran, 2-anilino-3-methyl-6-N-ethyl-N-isoamylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trichloromethylanilino-6-diethylaminofluoran, 2-butylamino-3-chloro-6-diethylaminofluoran, 2-ethoxyethylamino-3-chloro-6-diethylaminofluoran, 2-anilino-3-chloro-6-diethylaminofluoran, 2-diphenylamino-6-diethylaminofluoran, 2-anilino-3-methyl-6-diphenylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-diethylaminofluoran, 2-phenyl-6-diethylaminofluoran, 2-o-chloroanilino-6-6-butylanilinofluoran, 2-anilino-3-pentadecyl-6-diethylaminofluoran, 2-anilino-3-methyl-6-N-ethyl-N-tetrahydrofurfurylaminofluoran, 2-anilino-3-methyl-6-N-butyl-N-tetrahydrofurfurylaminofluoran, 2-anilino-3-methyl-6-N-ethyl-N-isobutylaminofluoran, 2-anilino-3-ethyl-6-dibutylaminofluoran, 2-anilino-3-ethyl-6-N-ethyl-N-isoamylaminofluoran, 2-anilino-3-methyl-6-N-ethyl-N-γ-methoxypropylaminofluoran, 2-anilino-3-phenyl-6-diethylaminofluoran, 2-diethylamino-3-phenyl-6-diethylaminofluoran, etc. Examples of the thiazine compounds include benzoyl Leucomethylene Blue, p-nitrobenzyl Leucomethylene Blue, etc. Examples of the spiropyran compounds are 3-methyl-spirodinaphthopyran, 3-ethyl-spirodinaphthopyran, 3,3'-dichlorospirodinaphthopyran, 3-benzyl-spirodinaphthopyran, 3-methylnaphtho(3methoxybenzo)spiropyran, 3-propylspirodibenzopyran, etc. These compounds may be used individually or in combination thereof.

A process for preparing the recording materials according to the present invention will be described below in detail.

The pressure-sensitive recording materials to which the present invention can be applied have various embodiments as described in U.S. Pat. Nos. 2,505,470, 2,505,471, 2,505,489, 2,548,366, 2,712,507, 2,730,456, 2,730,457 and 3,418,250, etc. In the most common embodiment, the pressure-sensitive recording material comprises at least one pair of sheets separately containing at least one electron donating leuco dye (color former sheet) and at least one electron accepting compound (developer sheet). The color former sheet can be prepared by dissolving one or more electron donating leuco dyes in a solvent, such as alkylated naphthalenes, alkylated diphenyls, alkylated diphenylmethanes, alkylated diarylethanes, synthetic oils (e.g., chlorinated paraffin), etc., dispersing the solution in a binder or incorporating the solution into microcapsules, and coating the resulting coating composition on a support, such as paper, a plastic sheet, resincoated paper, and the like. The developer sheet can be prepared by dispersing one or more electron accepting compounds according to the present invention and, if desired, other electron accepting compounds in a binder, such as a styrene-butadiene latex, polyvinyl alcohol, etc., and coating the resulting coating composition on a support, such as paper, a plastic sheet, resin-coated paper, and the like.

Amounts of the electron donating leuco dyes and electron accepting compounds to be used depend on the desired film thickness, the form of the pressure-sensitive recording material, the process for encapsulation, and other conditions and are, therefore, selected appropriately according to these conditions. It is easy for those skilled in the art to determine the amounts.

Processes for preparing microcapsules include a method utilizing coacervation of a hydrophilic colloid sol as disclosed in U.S. Pat. Nos. 2,800,457 and 2,800,458, an interfacial polymerization method as disclosed in British Pat. Nos. 867,797, 950,443, 989,264 and 1,091,076, etc., and the like.

For the preparation of heat-sensitive recording materials according to the present invention, at least one electron donating leuco dye, at least one electron accepting compound of the invention, and, if necessary, a heat-fusible substance are finely ground and mixed with a solution or dispersion of a binder in a solvent or a dispersion medium. To the mixture is then added an oil-absorbing pigment to prepare a coating composition. Examples of the oil-absorbing pigment to be added include kaolin, calcined kaolin, talc, agalmatolite, diatomaceous earth, calcium carbonate, aluminum hydroxide, magnesium hydroxide, magnesium carbonate, titanium oxide, barium carbonate, a urea-formalin filler, a cellulose filler, etc.

If desired, the coating composition can further contain a wax emulsion, a latex binder, a sensitivity-improving agent (e.g., 1,2-bis(4-methoxyphenylthio)ethane, 2-benzylthionaphthalene, etc.), a metallic soap, an antioxidant, an ultraviolet absorbent, an image preservability-improving agent, and so on.

In the above-described preparation of a coating composition, water is the most preferred as a solvent or dispersion medium.

Specific examples of the binder which can be used in the present invention include a styrene-butadiene copolymer, an alkyd resin, an acrylamide copolymer, a vinyl chloride-vinyl acetate copolymer, a styrene-maleic anhydride copolymer, synthetic rubber, gum arabic, polyvinyl alcohol, hydroxyethyl cellulose, carboxymethyl cellulose, etc. From the standpoint of compatibility with a solvent or dispersion medium, the preferred among these binders are water-soluble ones, such as gum arabic, polyvinyl alcohol, hydroxymethyl cellulose, carboxymethyl cellulose, etc.

The heat-fusible substances which may be used, if desired, are colorless solids at room temperature and show a sharp melting point in a temperature range suitable for heat recording, i.e., in the vicinity of from 70° to 160° C. Specific examples of such compounds include erucic acid, stearic acid, behenic acid, palmitic acid, stearamide, behenamide, stearic acid anilide, stearic acid toluidide, N-myristoyl-p-anisidine, N-myristoyl-p-phenetidine, 1-methoxycarbonyl-4-N-stearylcarbamoylbenzene, N-octadecylurea, N-hexadecylurea, N,N-didodecylurea, phenylcarbamoyloxydodecane, p-t-butylphenol phenoxyacetate, p-phenylphenol-p-chlorophenoxyacetate, 4,4'-isopropylidenebismethoxybenzene, β-phenylethyl-p-phenylphenyl ether, 2-p-chlorobenzyloxynaphthalene, 2-benzyloxynaphthalene, 1-benzyloxynaphthalene, 2-phenoxyacetyloxynaphthalene, diphenyl phthalate, phenyl 1-hydroxy-2-naphthoate, 2-benzoyloxynaphthalene, benzyl p-benzyloxybenzoate, hydroquinone acetate, 1-phenoxy-2-p-ethylphenoxyethane, 1,4-diphenoxybutane, 1-phenoxy-2-p-methoxyphenoxymethane, etc.

Waxes which can be used include paraffin wax, carnauba wax, microcrystalline wax, polyethylene wax, as well as higher fatty acid amides, such as stearamide, ethylenebisstearamide, higher fatty acid esters, and the like.

Metallic soaps which can be used include higher fatty acid polyvalent metal salts, such as zinc stearate, aluminum stearate, calcium stearate, zinc oleate, and the like.

Image preservability-improving agents to be added include hindered phenols in which at least one of the 2- and 6-positions is substituted with an alkyl group, and preferably a branched alkyl group, and derivatives thereof. Those having a plurality of phenol groups, particularly 2 or 3 phenol groups, in the molecule thereof are preferred. Specific examples of such compounds are bis[3,3-bis(4'-hydroxy-3'-t-butylphenyl)-butanoic acid]glycol ester, bis[3,3-bis(4'-hydroxy-3',4'-di-t-butylphenyl)butanoic acid]glycol ester, bis[3,3-bis(2'-methyl-4'-hydroxy-5'-t-butyl-phenyl)butanoic acid]glycol ester, 1,1,3-tris(2methyl-4-hydroxy-5-t-butylphenyl)butane, 4,4'-thiobis(3-methyl-6-t-butylphenol), 4,4'-thiobis(2-methyl-6-t-butylphenol), 2,2'-thiobis(4-methyl-6-t-butylphenol), 2,2'-methylene-bis(4-methyl-6-t-butylphenol), 2,2'-methylenebis(4-ethyl-6-t-butylphenol), 4,4'-butylidenebis(3-methyl-6-t-butylphenol), 4,4'-methylenebis(2,6-di-t-butylphenol), 2-t-butyl-4-t-butoxyphenol, 2,2-dimethyl-4-isopropyl-7-t-butyl-6-chromanol, 2,2-dimethyl-6-t-butyl-5-benzofuranol, 4{[4,6-bis(t-butylthio)-s-triazin-2-yl]amino}-2,6-di-t-butylphenol, etc. Use of these hindered phenols is particularly preferred for ensuring the effects of this invention, such as improvement of preservability of a developed color image, prevention of blooming, and the like.

The amount of the above-mentioned hindered phenols to be used ranges from 5 to 200%, and preferably from 20 to 100%, based on the weight of the electron accepting compound.

The thus-prepared coating composition is coated on a support, such as neutral paper, fine paper, plastic films, etc., and dried to obtain a heat-sensitive recording material. In the preparation of the coating composition, all the above-described components may be mixed previously and then ground, or appropriate combinations of the components are separately ground, followed by mixing altogether.

The coating composition may be impregnated into a support.

As a support, neutral paper is particularly preferred from the standpoint of prevention of fog before and after recording.

The heat-sensitive recording materials usually comprise from 1 to 2 parts by weight of an electron donating leuco dye, from 1 to 6 parts by weight of an electron accepting compound, up to 30 parts by weight of a heat-fusible substance, up to 15 parts by weight of a pigment, from 1 to 15 parts by weight of a binder, each per 100 parts by weight of a coating composition, and small proportions of other additives, dispersing agents, etc. The preferred amount of the electron donating leuco dye applied in the heat-sensitive recording materials is about 0.1 to 0.8 g/m$^2$, more preferably 0.2 to 0.5 g/m$^2$.

As described above, the compounds of formula (I) in accordance with the present invention are extremely useful as electron accepting compounds for use in pressure-sensitive recording materials and heat-sensitive recording materials. They are also applicable to electric heat-sensitive recording materials, photosensitive recording materials, ultrasonic recording materials, electron-sensitive recording materials, electrostatic recording materials, presensitized printing plates, printing materials, typewriter ribbon, ball point ink, crayon, and the like.

This invention will now be illustrated in greater detail with reference to the following examples, but it should be understood that they are not intended to limit the present invention. In these examples, all the precents are given by weight unless otherwise indicated.

EXAMPLE 1

Preparation of Color Former Sheet:

1 g of 2-anilino-3-methyl-6-diethylaminofluoran as an electron donating leuco dye was dissolved in 30 g of an alkylated naphthalene (i.e., diisopropyl-naphthalene). The resulting solution was added to 50 g of water having dissolved therein 6 g of gelatin and 4 g of gum arabic while vigorously stirring to obtain an emulsion comprising oil droplets having a diameter of from 1 to 10 μm. To the emulsion was added 250 g of water, and the emulsion was then adjusted to a pH of about 4 by adding acetic acid in small portions to cause coacervation to form capsule walls composed of gelatin and gum arabic around the oil droplets. After formalin was added thereto, the pH was raised to 9 to harden the capsule walls.

The resulting microcapsule dispersion was coated on paper and dried to obtain a color former sheet.

Preparation of Developer Sheet:

In 200 g of a 5% aqueous solution of polyvinyl alcohol was dispersed 20 g of 1-[bis(4-hydroxyphenyl)methyl]naphthalene as an electron accepting compound, and 20 g of kaolin (Georgia Kaolin) was thoroughly dispersed therein to prepare a coating composition. The resulting coating composition was coated on paper and dried to obtain a developer sheet.

When the above-prepared color former sheet and developer sheet were brought into contact with each other, and pressure or shock was applied thereto, a black image was instantaneously obtained. This image had a high density and excellent resistance to light and heat.

EXAMPLE 2

A developer sheet was prepared in the same manner as described in Example 1, except using 4-[1,1-bis(4-hydroxyphenyl)ethyl]bisphenyl as an electron accepting compound.

When the resulting developer sheet was brought into contact with the same color former sheet as prepared in Example 1, and pressure or shock was applied thereto, a black image was instantaneously obtained. This image had a high density and excellent resistance to light and heat.

EXAMPLE 3

A developer sheet was prepared in the same manner as described in Example 1, except using 4,4'-bis[1,1-bis(4-hydroxyphenyl)ethyl]biphenyl as an electron accepting compound.

When the resulting developer sheet was brought into contact with the same color former sheet as prepared in Example 1, and pressure or shock was applied thereto, a black image was instantaneously obtained. This image had a high density and excellent resistance to light and heat.

EXAMPLE 4

5 g of 2-anilino-3-methyl-6-N-methyl-N-cyclohexylaminofluoran as an electron donating leuco dye was dispersed together with 50 g of a 5% aqueous solution of polyvinyl alcohol (saponification degree: 99%; degree of polymerization: 1,000) in a ball mill for 1 day. Separately, 10 g of 2-[1,1-bis(4-hydroxyphenyl)ethyl]-naphthalene as an electron accepting compound was dispersed together with 100 g of a 5% aqueous solution of the same polyvinyl alcohol as used above in a ball mill for 1 day. On the other hand, 10 g of 2-benzoyloxynaphthalene, as an agent for improving color developability, was dispersed together with 100 g of a 5% aqueous solution of the same polyvinyl alcohol as used above in a ball mill for 1 day.

The resulting three kinds of dispersions were mixed, and 20 g of kaolin (Georgia Koalin) was thoroughly dispersed therein. To the dispersion was further added 5 g of a 50% dispersion of a paraffin wax emulsion (Cellosol #428, produced by Chukyo Yushi K.K.) to prepare a coating composition. The resulting coating composition was coated on neutral paper having a basis weight of 50 g/m$^2$ to a solid coverage of 6.5 g/m$^2$, followed by drying at 60° C. for 1 minute to obtain a heat-sensitive recording material.

On heating the resulting recording material with a heat energy of 40 mJ/mm$^2$ by means of a facsimile, a black image having a density of 1.00 was obtained.

When the thus-recorded image was left to stand at 40° C. and 90% RH for 24 hours, the densities of the color image and the non-image area (background) were 0.96 to 0.06, respectively.

Further, when a line was drawn on the coated layer of the recording material with a marking pen ink containing polyethylene glycol and dibutyl phthalate, no substantial discoloration was observed.

EXAMPLE 5

A heat-sensitive recording material was prepared in the same manner as described in Example 4, except replacing the electron donating leuco dye as used in Example 4 with 2.5 g of 2-anilino-3-chloro-6-diethylaminofluoran and 2.5 g of 2-anilino-3-methyl-6-N-methyl-N-cyclohexylaminofluoran and replacing the electron accepting compound as used in Example 4 with 10 g of 1-[bis(4-hydroxyphenyl)methyl]naphthalene.

On heat-recording in the same manner as in Example 4, a black image having a density of 1.01 was obtained.

EXAMPLE 6

A heat-sensitive recording material was prepared in the same manner as described in Example 4, except using 4-[1,1-bis(4-hydroxyphenyl)ethyl]biphenyl as an electron accepting compound.

When heat-recording was carried out in the same manner as in Example 4, a black image having a density of 1.00 was obtained.

When the thus-recorded image was allowed to stand at 40° C. and 90% RH for 24 hours, the densities of the color image and the non-image area (background) were 0.96 and 0.06, respectively.

EXAMPLE 7

A heat-sensitive recording material was prepared in the same manner as described in Example 5, except using 4-[1,1-bis(4-hydroxyphenyl)methyl]biphenyl.

On heat-recording in the same manner as in Example 4, a black image having a density of 1.01 was obtained.

EXAMPLE 8

A heat-sensitive recording material was prepared in the same manner as in Example 4, except using 4,4'-bis[1,1-bis(4-hydroxyphenyl)ethyl]biphenyl as an electron accepting compound.

On heat-recording in the same manner as in Example 4, a black image having a density of 0.99 was obtained.

When the thus-recorded image was allowed to stand at 40° C. and 90% RH for 24 hours, the densities of the color image and the non-image area (background) were 0.95 and 0.06, respectively.

Further, when a line was drawn on the coated layer of the recording material with a red marking pen (a product of Zebra), no substantial discoloration of the color image was observed.

EXAMPLE 9

A heat-sensitive recording material was prepared in the same manner as described in Example 5, except using 4,4'-bis[1,1-bis(4-hydroxyphenyl)methyl]-biphenyl as an electron accepting compound.

When heat-recording was carried out in the same manner as in Example 4, a black image having a density of 1.00 was obtained.

COMPARATIVE EXAMPLE 1

A heat-sensitive recording material was prepared in the same manner as described in Example 4, except using 2,2-bis(4-hydroxyphenyl)propane as an electron accepting compound.

When heat-recording was carried out in the same manner as in Example 4, the resulting color image had a density of 0.53.

Comparing the results of Examples 4 to 9 with the result of Comparative Example 1, it is apparent that the electron accepting compounds according to the present invention exhibit markedly improved color developability.

COMPARATIVE EXAMPLE 2

A heat-sensitive recording material was prepared in the same manner as described in Example 4, except using benzyl 4-hydroxybenzoate as an electron accepting compound. A color density obtained by heat-recording in the same manner as in Example 4 was 1.03.

When the thus-recorded image was allowed to stand at 40° C. and 90% RH for 24 hours, the density of the color image was decreased to 0.28.

Further, when a line was drawn on the coated layer of the recording material with the same marking pen as used in Example 4, the color image underwent serious discoloration.

It is apparent from a comparison between Examples 4, 6 and 8, and Comparative Example 2 that the recording materials in which the compounds of the present invention are used as electron accepting compounds are excellent in image preservability and solvent resistance.

While the invention has been described in detail and with reference to specific embodiments thereof, it will be apparent to one skilled in the art that various changes and modifications can be made therein without departing from the spirit and scope thereof.

What is claimed is:

1. A recording material comprising: one or more support(s), an electron donating leuco dye and one or more electron accepting compound(s), wherein said electron accepting compound(s) is/are represented by formula (I):

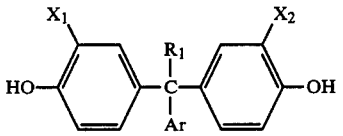

(I)

wherein $R_1$ represents a hydrogen atom, an alkyl group or an aryl group; Ar represents a substituted or unsubstituted polycyclic aryl group; and $X_1$ and $X_2$, which may be the same or different, each represents a hydrogen atom, a lower alkyl group, a lower alkenyl group or a halogen atom.

2. A recording material as in claim 1, wherein said electron accepting compound(s) is/are represented by formulae (II) or (III):

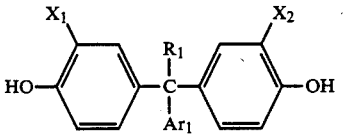

(II)

-continued

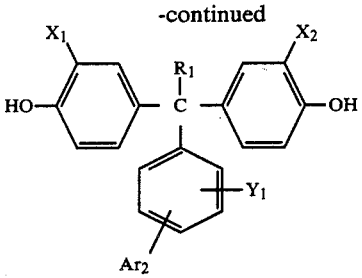

(III)

wherein $R_1$ represents a hydrogen atom, an alkyl group or an aryl group; $X_1$ and $X_2$, which may be the same or different, each represents a hydrogen atom, a lower alkyl group, a lower alkenyl group or a halogen atom; $Ar_1$ represents a condensed ring composed of substituted or unsubstituted 5- or 6-membered homocyclic or heterocyclic rings; $Ar_2$ represents a substituted or unsubstituted 5- or 6-membered homocyclic or heterocyclic ring or a condensed ring composed of substituted or unsubstituted 5- or 6-membered homocyclic or heterocyclic rings; and $Y_1$ represents a hydrogen atom, a halogen atom, an alkyl group or an alkoxy group.

3. A recording material as in claim 1, wherein said electron accepting compound(s) is/are represented by formulae (IV) or (V):

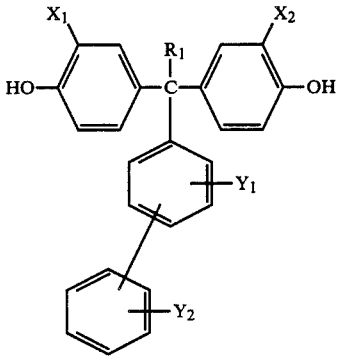

(IV)

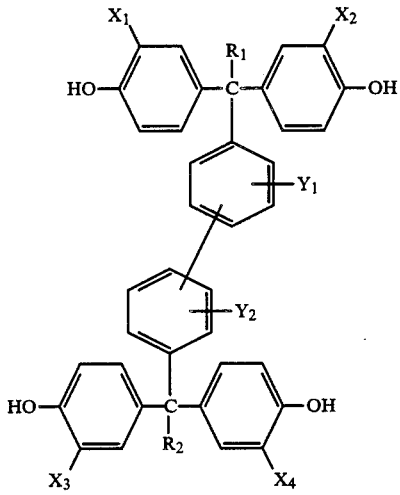

(V)

wherein $R_1$ and $R_2$, which may be the same or different, each represents a hydrogen atom, an alkyl group or an aryl group; $X_1$, $X_2$, $X_3$ and $X_4$, which may be the same or different, each represents a hydrogen atom, a lower alkyl group, a lower alkenyl group or a halogen atom; and $Y_1$ and $Y_2$, which may be the same or different, each represents a hydrogen atom, a halogen atom, an alkyl group or an alkoxy group.

4. A recording material as in claim 1, wherein $R_1$ is a hydrogen atom or a lower alkyl group.

* * * * *